United States Patent [19]

Stecker

[11] Patent Number: 5,055,324

[45] Date of Patent: Oct. 8, 1991

[54] METHOD OF FORMING A SYNTHETIC SURFACE SIMULATING STONE, MARBLE OR THE LIKE

[76] Inventor: William M. Stecker, Rte. 2, Box 23, Grand Meadow, Minn. 55936

[21] Appl. No.: 268,555

[22] Filed: Nov. 8, 1988

[51] Int. Cl.[5] ..... B05D 5/00

[52] U.S. Cl. ..... 427/281; 427/280

[58] Field of Search ..... 427/262, 263, 274, 280, 427/281, 267, 268

[56] References Cited

U.S. PATENT DOCUMENTS

| | | | |
|---|---|---|---|
| 3,055,148 | 9/1962 | Christy | 52/309.1 |
| 3,230,284 | 1/1966 | Iverson et al. | 264/73 |
| 3,341,396 | 9/1967 | Iverson | 428/142 |
| 3,488,246 | 1/1970 | Duggins | 428/15 |
| 3,562,379 | 2/1971 | Duggins | 264/171 |
| 3,706,825 | 12/1972 | Hall et al. | 264/75 |
| 3,848,039 | 11/1974 | Schneppenhorst | 264/73 |
| 4,248,816 | 2/1981 | Sheridan | 264/73 |
| 4,657,791 | 4/1987 | Ukkonen | 428/15 |
| 4,664,954 | 5/1987 | Hurd | 428/15 |

FOREIGN PATENT DOCUMENTS 8021937 10/1980 France .

501892 10/1970 Japan .

OTHER PUBLICATIONS

Billmeyer, Jr.; F. W., "Textbook of Polymer Science," third edition, New York, John Wiley & Sons, 1984, p. 480.

Hawley, G. G., "The Condensed Chemical Dictionary," ninth edition, New York, Van Nostrand Reinhold Co., 1977, p. 728.

*Primary Examiner*—Evan Lawrence

*Attorney, Agent, or Firm*—Dorsey & Whitney

[57] ABSTRACT

A method of preparing a synthetic surface having a pattern simulating stone, marble and various other naturally occurring substances. The method involves preparing a resin matrix and combining such with a matrix veining pigment composition having a pigment component with a specific gravity heavier than that of the resin system and a blooming agent component with a specific gravity less than that of the resin system. The pigment component is allowed to disperse under the influence of the blooming agent to form the pattern. A further aspect of the present invention includes controlling the dispersement of the veining pigment within the resin matrix by controlling its thixotropic properties.

15 Claims, No Drawings

METHOD OF FORMING A SYNTHETIC SURFACE SIMULATING STONE, MARBLE OR THE LIKE

BACKGROUND OF THE INVENTION

The present invention relates generally to a method of forming a synthetic surface material simulating various natural substances such as marble, stone, onyx, agate, jade, malachite and the like and more particularly, to a method of creating and manufacturing a synthetic material simulating various natural substances which utilizes a unique pigment and resin system.

Processes currently exist for forming synthetic materials and surfaces which give the appearance of or simulate various natural substances such as stone, marble and the like. Such materials are commonly used in the manufacture of floor and other types of tiles, countertops, sinks, architectural facings, ornamental objects, and generally for any other purpose that marble, stone or the like are used.

One example is a process utilizing a laminated sheet of material marketed under the trademark FORMICA. Such material is formed in large sheets and then cut and applied to the desired surface by adhesive or the like. Such sheets can be manufactured in solid colors or in various patterns, some of which simulate various stone or other textured material.

Another example is a process for preparing a material which is commonly referred to as "cultured marble". "Cultured marble" is formed by first creating a mold of a desired shape, spraying the internal mold surface with a gel coat and then filling the mold with a conventional casting resin. Pigments are added to the resin to give it the desired color or pattern. After the resins have set, the mold is removed with the surface facing the mold forming the outer surface of the finished product.

A further method is described in U.S. Pat. No. 3,341,396 issued to E. M. Iverson. In this patent, a base substrate is coated with a resin material, after which colored pigment is sprinkled onto the resin material. The resin material and colored pigment is then covered with a transparent coating and a tool is passed through the system to distribute the pigment.

Although many of the prior art methods for creating synthetic surfaces simulating stone, marble and the like are generally acceptable, there is a continuing effort to develop new and more desirable or pleasing patterns as well as patterns which more closely simulate the various natural materials such as stone, marble and the like. Accordingly, there is a continuing need and desire to improve upon existing methods.

SUMMARY OF THE INVENTION

In accordance with the method of the present invention, a synthetic surface is formed by preparing a resin system or matrix, adding a veining pigment composition comprising a "blooming" agent or vehicle, and pouring the same onto a flat substrate. The material generated by the present method displays a number of desirable aesthetic and physical properties which have not previously been achieved. These materials formed in accordance with the present invention more closely simulate synthetic rock, marble or the like while at the same time provide a surface which is very pleasing and one which is extremely durable, repairable and capable of relatively high heat resistance.

The desirable aesthetic properties of the material formed by the method of the present invention are created by utilizing a unique veining pigment system or composition in conjunction with a unique resin system. The pigment composition utilized in the method of the present invention includes a pigment component having a specific gravity greater than the specific gravity of the resin system and a blooming agent or component having a specific gravity less than the specific gravity of the resin system. When such a pigment composition is mixed into the resin system or matrix, the blooming agent tends to rise toward the surface, carrying small amounts of the pigment component with it. During this migration of the blooming agent toward the surface, small amounts of pigment are dropped to create a trail of pigment in the resin. This carrying of a portion of the pigment toward the surface is what the inventor has referred to as the "blooming" process. The portion of the pigment which is not carried toward the surface by the blooming agent tends to sink toward the bottom because its specific gravity is greater than that of the resin system.

The extent to which the "blooming" process is allowed to occur as well as the extent to which the pigment is allowed to sink to the bottom of the resin system depends, to a great extent, on the viscosity of the resin system. As a part of the present invention, the inventor has determined that certain desired patterns and effects, can be created by varying the thixotropy of the resin system. Thixotropy is a fluid property which causes its viscosity to vary as a function of its state of agitation and the previous history of motion within the fluid. Generally, the viscosity of a thixotropic fluid decreases as its state of agitation and length of agitation increases, and increases as its state of agitation and length of agitation decreases. Resin systems which exhibit thixotropic properties are able to be mixed and thus poured with relative ease and then, after having been poured and in a relative nonagitated state, exhibit significantly increased viscosity. This increased viscosity retards or limits the migration or dispersion (both "blooming" as well as sinking) of the pigments within the resin system and enables one to control the migration and dispersion of the pigment and to stop or fix such migration or dispersion at a desired point in time.

The preferred method contemplates preparation of the resin system, addition and slight mixing of the veining pigment composition and then pouring the mixture onto the substrate. It is contemplated, however, that the pigment composition could also possibly be added after the resin system has been poured, with the pigment either being allowed to sink and disperse naturally or as a result of mixing with a tool or by some other means. It is also contemplated that various additional veining can be added by using accent pigment to create the appearance of fissures and the like in the product.

Accordingly, it is an object of the present invention to provide a method of forming a synthetic surface of simulated stone, marble or the like.

Another object of the present invention is to provide a method of forming a synthetic surface which more closely simulates that of stone, marble or the like and/or which results in unique or more pleasing patterns.

A further object of the present invention is to provide a method for creating a synthetic surface simulating stone, marble or the like which utilizes a unique pigment composition comprising a pigment component having a specific gravity greater than that of the resin system and a blooming agent component having a specific gravity less than that of the resin system.

Another object of the present invention is to provide a method for forming a synthetic surface simulating stone, marble or the like in which unique patterns are formed and created by controlling the thixotropic properties of the resin system either separately or in combination with a unique pigment composition.

These and other objects of the present invention will become apparent with reference to the description of the preferred method and the appended claims.

DESCRIPTION OF THE PREFERRED METHOD

In general, the present invention relates to a method of forming a synthetic surface simulating the appearance of stone, marble or various other naturally occurring materials. The method steps involved in the present invention include preparing the resin system or matrix, adding a pigment composition to the resin matrix and then applying the same to a substrate.

In the preferred method, the step of preparing the resin system or matrix includes the substeps of selecting the base or primary resin, adding a tinting pigment (if desired) and adding any fillers or other materials to control the properties of the product when cured or the matrix during the forming process. A curing agent or catalyst is then added and all of the ingredients are thoroughly mixed.

The preferred method of the present invention contemplates the use of a conventional polyester, isophthalic casting resin as the primary or base resin. Such resins or resin blends are available through a variety of sources and are generally known in the art. Suitable polyester resins are those prepared from polymerizable unsaturated polyesters such as those prepared from ethylenically unsaturated polycarboxcylic acids and polyhydric alcohols. Preferably the primary resin, when fully cured, provides desirable heat, chemical and moisture resistance. A preferred polyester casting resin is a styrated isophthalic casting resin.

Although the preferred resin system is comprised of an isophthalic polyester resin, it is contemplated that an orthophthalic polyester casting resin can be utilized as well. It is also contemplated that various other resins could be utilized. Possible other polymeric resins include methylmethacrylate and epoxy resin systems. Further, it is possible that the primary resin could be comprised of a blend or mixture of different resin components, provided that the various resin components are compatible with one another.

The resin system or matrix preparation step also includes the possible substeps of adding tinting pigments, fillers and/or other components for the purpose of providing background colorant to the material and providing certain properties and characteristics to the resin system during formation and after it has cured. For example, if a certain tint or color is desired, an appropriate pigment such as titanium dioxide or any one of various other pigments can be added. Certain materials may be added for the purpose of reducing the coefficient of thermal expansion of the cured system or providing such system with various other desired properties.

One embodiment of the present method contemplates the addition of a fire retardant filler such as alumina trihydrate to provide fire retardancy to the end product. Although alumina trihydrate is preferred, other possible compositions are available for accomplishing the same purpose. When fire retardant properties are desired in the final product formed in accordance with the present invention, the inventor has found that up to 50% by weight, and preferably between about 30% and 50% by weight, of alumina trihydrate may be added to the primary resin. As will be described in greater detail below, addition of certain fillers such as alumina trihydrate may dictate modifications to the veining pigment composition or the addition of viscosity reducing agents or plasticizers in order for such pigment to sink and "bloom" in accordance with the present invention.

It is also contemplated that certain components can also be added to the resin system to control the viscosity and/or the thixotropy of the resin system or matrix in order to better control the dispersion of the veining pigments. In this regard, an aspect of the present invention includes controlling the thixotropy of the resin matrix by addition of a thixotropic agent such as fumed silica or the like. Addition of such an agent provides the resin system with thixotropic properties which results in its viscosity varying generally inversely as a function of its state of agitation. In other words, as the resin system is agitated, its viscosity will decrease, while as its state of agitation is decreased, its viscosity will increase. These thixotropic properties provide the resin system or matrix with a first viscosity to permit the same to be mixed and poured and to flow to a desired thickness, and a second viscosity to thereafter control and ultimately stop the dispersion of the veining pigment.

In the preferred method of the present invention, a small amount of fumed silica or other thixotropic agent is added to the resin base to establish the desired thixotropic property of the resin system. Preferably the thixotropic properties of the resin system or matrix results in sufficiently decreased viscosity during slight agitation (i.e. mixing and pouring) to permit the matrix to be easily mixed and poured and to flow to a desired film thickness on the substrate. A desired film thickness is generally about 1 to 15 mm, and preferably about 2 to 4 mm. A viscosity of less than about 1200 centipoise or about 800 to 1200 centipoise, and preferably less than about 1000 centipoise or about 800 to 1000 centipoise, during the mixing, pouring and flowing of the matrix is desirable.

The preferred thixotropic properties of the resin system also results in sufficiently increased viscosity after the matrix has flowed to a desired film thickness and is generally at rest or in a nonagitated state to stop further dispersion of the veining pigment within a desired time after reaching this state. Preferably, dispersion of the veining pigment should be stopped within about 15 seconds to 5 minutes after the matrix has flowed to the desired film thickness. A viscosity greater than about 1200 centipoise or between about 1200 to 6000 centipoise, and preferably greater than about 2000 centipoise or between about 2000 to 3000 centipoise, is desirable for accomplishing this objective. In the preferred system, approximately ¼% to 3% by weight of fumed silica is added to the base resin to establish the desired degree of thixotropy.

Following addition of the above tinting pigments, fillers and other materials, the base resin is thoroughly mixed.

Preparation of the resin system or matrix also includes the substep of adding the curing agent or catalyst which initiates the desired crosslinking and causes the resin to cure. There are, of course, a wide variety of catalysts or curing or crosslinking agents that may be utilized. Many of these have fairly broad application to a variety of resins or resin blends, while others are more specific. In the preferred system of the present invention, methylethyl ketone peroxide (MEKP) is used as the catalyst. The amount of catalyst added to the resin system can vary depending upon a number of factors including the speed with which curing is desired, the temperature under which the curing is to occur, etc. In the preferred method, approximately 2% to 4% by weight of the catalyst MEKP is added to the polyester resin and thoroughly mixed for curing at a temperature of about 70° to 100° F. It is also contemplated that the primary resin could be self curing, in which case a catalyst is not needed.

Following the preparation of the resin system or matrix as described above, the veining pigment composition is prepared, added to the matrix, mixed slightly, and then poured onto a flat substrate. In accordance with the preferred method, such a substrate comprises a flat sheet of material such as plywood, pressed wood or the like. A side edge of limited height for the purpose of restraining the flow of the poured matrix is also provided. It is also contemplated that the substrate can be provided with a release coating or the like if a sheet of the resulting material is desired.

During the preferred method, the veining pigment composition which has been added to the matrix and slightly mixed is poured onto the substrate and allowed to flow to the edges where it is retained and allowed to cure. In the preferred method, the resin with added veining pigment can be poured in strips or in various other patterns. It is also contemplated that the resin with added veining pigment can be poured and subsequently further mixed. It is also contemplated that the resin system can be first poured and then followed by addition of the veining pigment, either with or without subsequent mixing.

The veining pigment composition utilized in the method of the present invention comprises a conventional pigment component such as titanium dioxide having a specific gravity greater than that of the resin system, together with a blooming or floatation agent component having a specific gravity less than that of the resin system. In the preferred method, the blooming agent is generally immiscible with respect to the pigment component. It is also preferable for the blooming agent to be compatible with the particular resin system being utilized. In other words, it is desirable for the blooming agent to not chemically or physically react with the resin system so as to reduce or affect the properties of that system. Acceptable blooming agents generally include solvents of the particular resin system being utilized, such as styrene, as well as various compatible oils and unsaturated resins. Surfactants such as detergents are also acceptable.

In the preferred system, the specific blooming agent utilized is a surfactant comprising a soybean oil derivative sold by Amway under the trademark LOC and comprises approximately 2% to 50% by weight of the veining pigment composition. When the veining pigment composition is added to the resin system, slightly mixed, poured onto the substrate and allowed to flow to the desired thickness, the veining pigment will disperse within the resin system. The majority of the pigment component, which has a specific gravity greater than that of the resin, tends to sink as a result of gravity toward the supporting substrate. The rate at which this sinking occurs is primarily dependent upon the viscosity of the resin system.

A minority portion of the pigment component is carried by the blooming agent, which has a specific gravity less than that of the resin, toward the top surface or away from the substrate. As some of the pigment is carried upwardly toward the surface by the blooming agent, and as the remainder of the pigment sinks, trails of pigment are left behind, thereby creating three-dimensional patterns in the transparent/transluscent resin system or matrix. This creates the illusion of internal veining within the system. The sinking portion of the pigment tends to form tonal variations in the background giving the illusion of great depth.

In the preferred method, the veining pigment composition includes a pigment component in the amount of about 50% to 98% by weight, and preferably about 90% to 98% by weight. The pigment component has a specific gravity greater than that of the resin. The veining pigment composition also includes a blooming agent component in an amount of about 2% to 50% by weight, and preferably about 2% and 10% by weight, of a material with a specific gravity less than that of the resin. In the preferred method, the pigment component is comprised of titanium dioxide or various other pigments dispersed in a polyester base. These are commercially available as are various other acceptable pigments. The blooming agent is comprised of methylethyl ketone (MEK) or any other resin system solvent, as well as various surfactants, oils, waxes, paraffins and unsaturated polyester resins which are compatible with the resin system and have a specific gravity less than that of the resin system. The veining pigment composition is combined with the resin matrix at the rate of from trace amounts of pigment up to about two grams of pigment per gallon of matrix.

The amount of blooming agent in the veining pigment composition depends, to some extent, on the desired look of the final product. It also depends on the particular resin system being utilized and the properties of such resin system. For example, in one resin system, approximately 50% by weight of alumina trihydrate or other similar material is added in order to induce desired fire retardant properties. Because of the introduction of this material, the composition of the veining pigment must be altered and a viscosity reducing agent or plasticizer must be added to the resin system to overcome the problems arising from the significantly increased viscosity. This involves addition to the resin system of approximately 3% to 10% triethylphosphate by weight as a viscosity reducing agent or plasticizer for the purpose of decreasing the viscosity of the system. It also involves the addition of a sufficient amount of a surfactant or blooming agent for the purpose of assisting in driving the pigments through the resin system. In the particular system in which up to 50% by weight of alumina trihydrate is added to the resin system, about 3% to 10% by weight of triethylphosphate or a viscosity reducing agent should be added to the resin system. The veining pigment should also preferably include as much as 50% by weight of a suitable surfactant or blooming agent such as the soybean oil derivative sold by Amway under the trademark LOC.

In preparing the veining pigment composition, the pigment component and the blooming agent are thoroughly mixed so that the pigment is dispersed in the blooming agent. Thus, the relative properties of the blooming agent must be such that a dispersion will result upon such mixing.

Following the pouring of the blended resin matrix and veining pigment, additional accent or veining can be formed by preparing a quantity of accent pigment or material and pouring limited amounts in a desired pattern onto the substrate. Because the accent pigment, which is comprised principally of pigment and a portion of the resin matrix, has a specific gravity greater than that of the resin, it tends to sink and provides accent or fissure lines in the final product.

The method of the present invention is further illustrated by the following examples:

EXAMPLE 1

Simulation of a quartz-like stone surface was formed by preparing a resin matrix utilizing a conventional styrated isophthalic polyester resin as the base resin. The particular base resin utilized had a viscosity at room temperature of about 700 centipoise. To this base resin were added ½% by weight of fumed silica as a thixotropic agent, ¼ gram per gallon of titanium dioxide as a tinting pigment and 2% by weight of methylethyl ketone peroxide (MKEP) as the catalyst. These ingredients were then thoroughly mixed to produce the resin matrix.

A small quantity of accent pigment or material was then prepared by adding 20 grams of metal coated mica pigment with 40 grams of the base resin along with 2% by weight of the catalyst MEKP and thoroughly mixing the same. This mixture was then partially mixed with 200 ml. of the resin matrix, to produce the accent pigment mixture.

The veining pigment composition was then prepared by thoroughly mixing 95% by weight titanium dioxide pigment and 5% by weight of a surfactant, namely, the soybean oil derivative sold by Amway Corporation under the trademark LOC. This veining pigment composition was partially blended with the resin matrix at the rate of about ½ gram of veining pigment composition per gallon of resin matrix. The resulting blend was poured in strips approximately 8 inches to 18 inches wide and allowed to flow to the side edges of a flat substrate provided with side edges. Following the pour, limited amounts of the accent pigment were used to form accent or fissure lines by pouring the same in desired patterns onto the substrate. The accent pigment, having a greater specific gravity than that of the resin matrix tended to sink to the bottom of the poured resin thereby creating desirable fissure lines.

The poured resin mixture was cured at 110° F. for four hours. The final film thickness was ⅛ inch and exhibited highly desirable aesthetic properties.

EXAMPLE 2

A simulation of a marble surface was prepared by utilizing a base resin similar to that in Example 1 above and adding ½% by weight of fumed silica. This resin/-fumed silica mixture was divided in two equal parts. Titanium dioxide pigment was added to one part at the rate of ¼ gram of pigment per gallon of resin and was added to the second part at the rate of 2 grams of pigment per gallon of resin. Both parts were catalyzed with 2% by weight MEKP and thoroughly mixed to produce a first and second resin matrix respectively.

An accent pigment material was prepared as in Example 1 above.

A veining pigment composition comprising 95% titanium dioxide and 5% of the surfactant utilized in Example 1 was prepared and added to the first resin matrix at the rate of ½ gram of veining pigment composition per gallon of resin solution and slightly mixed. Equal portions of the first resin matrix (with added veining pigment composition) and the second resin matrix were combined, mixed slightly and poured onto a substrate as in Example 1 above. Accent veining was also conducted as in Example 1 above. The resulting poured material was cured at 100° for four hours. The thickness of the resulting product was ⅛ inch and provided an aesthetically pleasing, marble-like surface.

Having described the details regarding the various components and compositions utilized in the method of the present invention, the method can be further summarized as follows. First, a resin system or matrix is prepared by selecting a primary resin or resin blend and, if needed or desired, adding various materials to the primary resin. These materials may include a tinting pigment as well as materials which affect the ultimate properties of the cured resin or the properties of the resin system or matrix during formation of the product.

One aspect of the method of the present invention involves the addition of a thixotropic agent such as fumed silica or the like to the resin for the purpose of controlling the viscosity of the matrix while the same is being mixed and poured and after it has been allowed to flow to its desired thickness. It has been found that addition of approximately ¼% to 3% by weight of fumed silica to the primary resin provides acceptable thixotropic properties. This permits the matrix to be easily mixed and poured and to flow to a desired thickness, and after this has occurred, to have a sufficiently increased viscosity to stop the further dispersion of the veining pigment at a desired point in time.

A further aspect of the present invention is to add a fire retardant component to the primary resin. Preferably, this involves adding up to 50% by weight of alumina trihydrate. When such material is added, the viscosity is significantly increased to the point where it is necessary to add viscosity reducing agents or plasticizers to the matrix and additional blooming agent and/or surfactants to the veining pigment in order to help drive the pigments through the resin system.

After preparation of the resin matrix, the veining pigment composition is added, mixed slightly and poured onto the substrate. In the preferred method, the veining pigment composition includes a pigment component having a specific gravity less than that of the resin system and comprising about 50% to 98% by weight of the composition and a blooming agent having a specific gravity less than that of the resin system and comprising about 2% to 50% by weight of the composition. As the matrix is poured onto the substrate and allowed to flow to its edges, the veining pigment disperses within the resin system as a result of the heavier pigment component sinking toward the bottom and a part of the pigment being carried upwardly toward the surface of the matrix as a result of the blooming agent. This dispersion of the pigment continues until it is stopped as a result of the increase in viscosity of the matrix due to its thixotropic properties.

Although the description of the present invention has been quite specific, it is contemplated that various modifications could be made without deviating from the spirit thereof. Accordingly, it is intended that the scope of the present invention be dictated by the appended claims rather than by the description of the preferred embodiment.

I claim:

1. A method of preparing a synthetic surface material having a pattern simulating stone, marble or the like comprising the steps of:

a. preparing a transparent or translucent resin matrix;

b. adding a veining pigment composition to said resin matrix in which said veining pigment composition includes a pigment component having a specific gravity greater than the specific gravity of said resin matrix and a blooming agent component having a specific gravity less than the specific gravity of said resin matrix;

c. applying the mixture of said resin matrix and veining pigment composition to a substrate and allowing said pigment to disperse under the influence of said blooming agent component to form said pattern; and d. curing said mixture of resin matrix and veining pigment composition.

2. A method of preparing a synthetic surface material having a pattern simulating stone, marble or the like comprising the steps of:

a. preparing a transparent or translucent resin matrix;

b. adding a veining pigment composition to said resin matrix in which said veining pigment composition includes a pigment component having a specific gravity greater than the specific gravity of said resin matrix and a blooming agent component having a specific gravity less than the specific gravity of said resin matrix wherein said veining pigment composition includes about 50% to 98% by weight of said pigment component and about 2%-20% by weight of said blooming agent component and wherein said pigment component and said blooming agent component are immiscible with respect to the other;

c. applying the mixture of said resin matrix and veiling pigment composition to a substrate and allowing said pigment to disperse under the influence of said blooming agent component to form said pattern; and d. curing said mixture of resin matrix and veining pigment composition.

3. The method of claim 2 wherein said veining pigment composition includes about 90% to 98% by weight of said pigment component and about 2% to 10% by weight of said blooming agent component.

4. A method of preparing a synthetic surface material having a pattern simulating stone, marble or the like comprising the steps of:

a. preparing a transparent or translucent resin matrix;

b. adding a veining pigment composition to said resin matrix in which said veining pigment composition includes a pigment component having a specific gravity greater than the specific gravity of said resin matrix and a blooming agent component having a specific gravity less than the specific gravity of said resin matrix wherein said step of preparing said resin matrix includes the addition of a thixotropic agent for the purpose of controlling the dispersion of the veining pigment composition;

c. applying the mixture of said resin matrix and veining pigment composition to a substrate and allowing said pigment to disperse under the influence of said blooming agent component to form said pattern; and d. curing said mixture of resin matrix and veining pigment composition.

5. The method of claim 4 wherein said thixotropic agent comprises fumed silica.

6. The method of claim 5 wherein said fumed silica is present in said resin matrix in the amount of between about ¼% to 3% by weight.

7. The method of claim 4 wherein the addition of said thixotropic agent is effective to provide said resin matrix with a first viscosity when said resin matrix is being mixed and poured and a second viscosity when said resin matrix is substantially at rest, said first viscosity being sufficiently low to permit said resin matrix to be easily mixed and poured and said second viscosity being sufficiently high to stop the dispersion of veining pigment within about 15 seconds to 5 minutes after said resin matrix is substantially at rest.

8. The method of claim 7 wherein said first viscosity is less than said second viscosity.

9. The method of claim 8 wherein the addition of said thixotropic agent is sufficient to provide said resin matrix with a first viscosity of less than about 1200 centipoise and a second viscosity greater than about 1200 centipoise.

10. The method of claim 9 wherein said first viscosity is less than about 1000 centipoise and said second viscosity is greater than about 2000 centipoise.

11. The method of claim 1 wherein the step of preparing said resin matrix includes adding a fire retardant material.

12. The method of claim 11 wherein said fire retardant material is alumina trihydrate.

13. The method of claim 12 wherein said alumina trihydrate is present in an amount of up to about 50% by weight of said resin matrix.

14. The method of claim 13 including adding a viscosity reducing agent to said resin matrix.

15. The method of claim 14 wherein said viscosity reducing agent is triethylphosphate and is present in the amount of between about 3% and 10% by weight.

* * * * *

UNITED STATES PATENT AND TRADEMARK OFFICE

CERTIFICATE OF CORRECTION

PATENT NO. : 5,055,324

DATED : October 8, 1991

INVENTOR(S) : William M. Stecker

It is certified that error appears in the above-identified patent and that said Letters Patent is hereby corrected as shown below:

In column 9, line 31, delete "20%" and insert --50%--.

Signed and Sealed this

Nineteenth Day of January, 1993

*Attest:*

DOUGLAS B. COMER

*Attesting Officer*

*Acting Commissioner of Patents and Trademarks*